US010464721B2

(12) United States Patent
Kim

(10) Patent No.: US 10,464,721 B2
(45) Date of Patent: Nov. 5, 2019

(54) VAPOR-TIGHT CONTAINER

(71) Applicant: Honest Food Co., Ltd., Jeollabuk-do (KR)

(72) Inventor: Su Seok Kim, Jeollabuk-do (KR)

(73) Assignee: Honest Food Co., Ltd., Jeollabuk-do (KR)

( * ) Notice: Subject to any disclaimer, the term of this patent is extended or adjusted under 35 U.S.C. 154(b) by 157 days.

(21) Appl. No.: 15/628,799

(22) Filed: Jun. 21, 2017

(65) Prior Publication Data

US 2017/0369212 A1 Dec. 28, 2017

(30) Foreign Application Priority Data

Jun. 22, 2016 (KR) ..... 10-2016-0077817
Jun. 16, 2017 (KR) ..... 10-2017-0076668

(51) Int. Cl.

*B65D 51/16* (2006.01)
*B65D 43/02* (2006.01)
*A47J 36/06* (2006.01)
*B65D 8/00* (2006.01)

(52) U.S. Cl.

CPC ..... *B65D 43/02* (2013.01); *B65D 11/02* (2013.01); *B65D 43/0208* (2013.01); *B65D 51/1644* (2013.01); *B65D 2543/00064* (2013.01); *B65D 2543/00101* (2013.01); *B65D 2543/00194* (2013.01); *B65D 2543/00296* (2013.01); *B65D 2543/00518* (2013.01); *B65D 2543/00537* (2013.01); *B65D 2543/00555* (2013.01); *B65D 2543/00657* (2013.01); *B65D 2543/00685* (2013.01); *B65D 2543/00759* (2013.01); *B65D 2543/00768* (2013.01); *B65D 2543/00796* (2013.01); *B65D 2543/00842* (2013.01)

(58) Field of Classification Search

CPC ..... A47J 27/0815; A47J 36/027; A47J 36/06; A47J 36/38; B65D 43/02; B65D 43/0208; B65D 43/0216; B65D 11/02; B65D 51/1644; B65D 51/1661; B65D 2543/00064; B65D 2543/00101; B65D 2543/00194; B65D 2543/00296; B65D 2543/00518; B65D 2543/00537; B65D 2543/00555; B65D 2543/00657; B65D 2205/00; B65D 81/2038; B65D 81/3446; B65D 81/3453; B65D 77/225

USPC ..... 220/782, 203.27, 203.29, 361, 780, 793, 220/366.1, 912, 367.1, 203.01, 745; 219/731, 735, 725; 426/243

See application file for complete search history.

(56) References Cited

U.S. PATENT DOCUMENTS 2,767,711 A * 10/1956 Ernst ..... A61F 9/0008 206/438
3,055,536 A * 9/1962 Dieny ..... A47J 27/0815 220/203.11
3,339,786 A * 9/1967 Biglin ..... B65D 43/0212 206/515

(Continued)

FOREIGN PATENT DOCUMENTS

KR 20-2010-0007714 7/2010

*Primary Examiner* — Gideon R Weinerth

(57) ABSTRACT

Disclosed is a vapor-tight container comprising a container body having a first extension formed to extend outwards along a rim of a sidewall thereof and a locking protrusion bent downwards from an end of the first extension, and a container lid configured to cover an upper portion of the container body so that the inside of the container body is sealed.

6 Claims, 10 Drawing Sheets

(56) References Cited

U.S. PATENT DOCUMENTS 3,454,182 A * 7/1969 Morton ..... B61F 15/22 137/513.5
3,862,614 A * 1/1975 Kovac ..... B65D 41/22 206/820
4,143,787 A * 3/1979 Walker ..... A47J 27/09 137/467
4,549,668 A * 10/1985 Krauss ..... B65D 51/1644 220/203.27
5,293,813 A * 3/1994 Schultz ..... A47J 27/0811 99/337
5,750,967 A * 5/1998 Sprauer, Jr. ..... A47J 27/04 219/725
5,806,703 A * 9/1998 Grandi ..... B65D 51/1644 220/203.02
6,056,138 A * 5/2000 Chen ..... B65D 43/0212 206/505
6,196,404 B1 * 3/2001 Chen ..... B65D 43/0212 206/505
6,460,716 B1 * 10/2002 Wong ..... B65D 21/022 220/4.24
7,074,443 B2 * 7/2006 Thomas ..... B65D 51/1644 220/203.01
7,614,522 B2 * 11/2009 Hsu ..... A47J 36/06 220/367.1
7,891,514 B1 * 2/2011 Walsh ..... B65D 43/0212 220/4.21
8,091,732 B2 * 1/2012 Bryson ..... B65D 43/0208 220/780
8,146,765 B2 * 4/2012 Chen ..... B65D 43/022 215/262
8,317,044 B2 * 11/2012 Wu ..... B65D 21/0222 206/508
2003/0116572 A1 * 6/2003 Klock ..... A47J 36/027 220/367.1
2003/0155365 A1 * 8/2003 Llorente Lecue ... B65D 43/021 220/802
2004/0245261 A1 * 12/2004 Stanos ..... B65D 43/0208 220/793
2006/0000842 A1 * 1/2006 Maxwell ..... B65D 43/0208 220/780
2007/0007163 A1 * 1/2007 Schlattl ..... B65D 81/2038 206/543
2007/0007297 A1 * 1/2007 Li ..... B65D 43/0212 220/782
2007/0045304 A1 * 3/2007 Liang ..... A47J 36/027 219/735
2008/0073366 A1 * 3/2008 Backaert ..... B65D 79/005 220/785
2008/0105674 A1 * 5/2008 Hsu ..... A47J 36/027 219/735
2008/0149641 A1 * 6/2008 Segal ..... B65D 43/0208 220/526
2008/0197134 A1 * 8/2008 Maxwell ..... B65D 51/1627 220/367.1
2009/0107993 A1 * 4/2009 Ohyama ..... A47J 27/10 219/731
2009/0166362 A1 * 7/2009 Olsson ..... B65D 77/225 220/367.1
2009/0200296 A1 * 8/2009 Iwasaki ..... B29C 45/33 219/735
2010/0200588 A1 * 8/2010 Bergman ..... B65D 81/2038 220/203.01
2010/0237070 A1 * 9/2010 Coonce ..... B65D 45/20 220/203.29
2010/0263328 A1 * 10/2010 Dorsey ..... B65D 43/0218 53/432
2013/0284727 A1 * 10/2013 Tai ..... H05B 6/6479 219/731
2014/0072680 A1 * 3/2014 Dilonardo ..... G04G 21/00 426/243
2016/0152387 A1 * 6/2016 Loaiza Alvarez .... A47J 36/027 220/203.09
2018/0014690 A1 * 1/2018 Oh ..... A47J 36/06
2018/0146821 A1 * 5/2018 Lu ..... A47J 36/38

* cited by examiner (b)

VAPOR-TIGHT CONTAINER

CROSS-REFERENCE TO RELATED APPLICATION

This application claims priority of Korean Patent Application No. 10-2016-0077817, filed on Jun. 22, 2016 and priority of Korean Patent Application No. 10-2017-0076668, filed on Jun. 16, 2017, in the KIPO (Korean Intellectual Property Office), the disclosure of which is incorporated herein entirely by reference.

BACKGROUND OF THE INVENTION

Field of the Invention

The present disclosure relates to a container for a vapor or the like, and more particularly, to a vapor-tight container in which a container lid is more tightly coupled to a container body by means of a vapor pressure generated in the container body and applied to an accommodation portion since an accommodating shape is formed in a rim extension portion of the container lid.

Description of the Related Art

Generally, food is stored in various kinds of vessels or containers. Such a food storage container generally includes a container body giving an accommodation space therein and having an opening, a lid for opening and closing the opening, and a fixing means for fixing the lid to the body. As the fixing means provided at the container, a fixing member hinged to the lid or the body to fix the lid to the body and thus seal the body is frequently used.

However, in the case where the food storage container has four fixing members at four sides of the container body, a user has to manually separate the four fixing members one by one when opening the lid, which is so inconvenient. In addition, it is inconvenient to carry and store the food storage container due to a large volume when it is not in use.

Meanwhile, in the case of cooking or warming food in the container by using a vapor, the vapor should not leak to the outside within a certain temperature range. However, there is no suitable container to solve this problem.

SUMMARY OF THE INVENTION

This disclosure is directed to providing a vapor-tight container from which a vapor is not leaked.

The present disclosure is also directed to providing a vapor-tight container which may have a minimized volume when being stored.

In one general aspect of the present disclosure, there is provided a vapor-tight container, comprising: a container body having a first extension formed to extend outwards along a rim of a sidewall thereof and a locking protrusion bent downwards from an end of the first extension; and a container lid configured to cover an upper portion of the container body so that the inside of the container body is sealed, wherein the container lid includes: a second extension formed to extend from a rim of the container lid and form an accommodation portion in an upper direction from a horizontal portion of the first extension so that a vapor generated in the container body is accommodated therein, the second extension being closely adhered to an upper end surface of the first extension; and a coupling unit formed at a lower portion of the second extension and secured to surround the locking protrusion formed at the container body.

In another aspect of the present disclosure, there is provided a vapor-tight container, comprising: a container body having a first extension formed to extend outwards along a rim of a sidewall thereof and a coupling groove formed at an end of the first extension and having an open upper portion; and a container lid configured to cover an upper portion of the container body so that the inside of the container body is sealed, wherein the container lid includes: a second extension formed to extend from a rim of the container lid and form an accommodation portion in an upper direction from a horizontal portion of the first extension so that a vapor generated in the container body is accommodated therein, the second extension being closely adhered to an upper end surface of the first extension; and a coupling protrusion located at an end of the second extension and detachably inserted into the coupling groove.

A discharge hole may be formed in the container lid, and a check valve may be further provided to open or close the discharge hole, The container lid may be made of a flexible material and further include a handle formed to extend outwards at one side of the container lid, and a fitting groove may be formed in the handle so that the check valve is inserted therein.

The check valve may include a coupling portion fit into the discharge hole, an opening plate formed at an upper portion of the coupling portion and closely adhered to an upper surface of the discharge hole to seal the discharge hole, and a fitting protrusion formed at an upper portion of the opening plate so that the fitting groove formed at the handle is fit therein.

The check valve may include a valve body inserted into the discharge hole to close the discharge hole and having a valve space formed therein, a valve component movably accommodated in the valve space, and an elastic member accommodated in the valve space to apply an elastic force to the valve component, and the valve body may have an inside path for connecting the valve space and an inner space of the container body, and an outside path for connecting the valve space and the outside of the container lid.

The elastic member may be a compression coil spring.

The check valve may include a valve body inserted into the discharge hole to close the discharge hole and having a valve space formed therein with open upper end lower ends, and a valve cover movably inserted into the open end of the valve body.

The container lid may be made of a flexible material, and the vapor-tight container may further comprise a ring formed at one side of the container lid to fix the container lid in a folded or rolled state.

The cover portion may further include a sealing portion 210 protruding downward at an inner end of the second extension and closely adhered to an inner surface of the upper end of the sidewall of the container body.

In the vapor-tight container according to the present disclosure, an accommodation portion is formed in a rim portion of a container lid, and thus the container lid is more closely adhered to a container body due to the vapor pressure generated in the container body, which prevents the vapor from being leaked.

In addition, in the vapor-tight container according to the present disclosure, the container body and the container lid are made of silicone material, and in a state where the container body and the container lid are folded or rolled, a fitting groove formed at a handle is fixed to a fitting protrusion formed at a the check valve, so that the volume of the container is minimized when the container is stored. In particular, the container body and the container lid may be stored in a folded or rolled even though they are coupled to each other.

BRIEF DESCRIPTION OF THE DRAWINGS

The above and other features and advantages will become more apparent to those of ordinary skill in the art by describing in detail exemplary embodiments with reference to the attached drawings, in which.

In the following description, the same or similar elements are labeled with the same or similar reference numbers.

DETAILED DESCRIPTION

Figure 1:
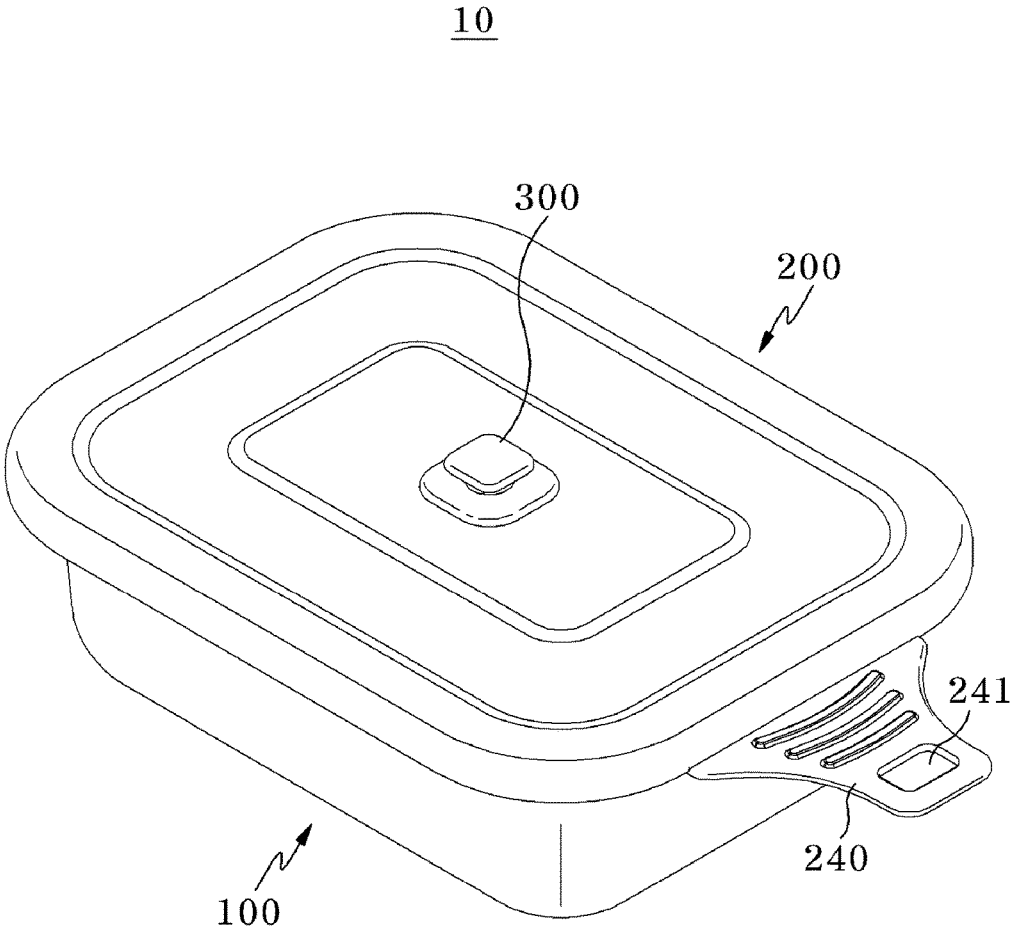
FIG. 1 is a perspective view showing a vapor-tight container according to an embodiment of the present disclosure.
Figure 2:
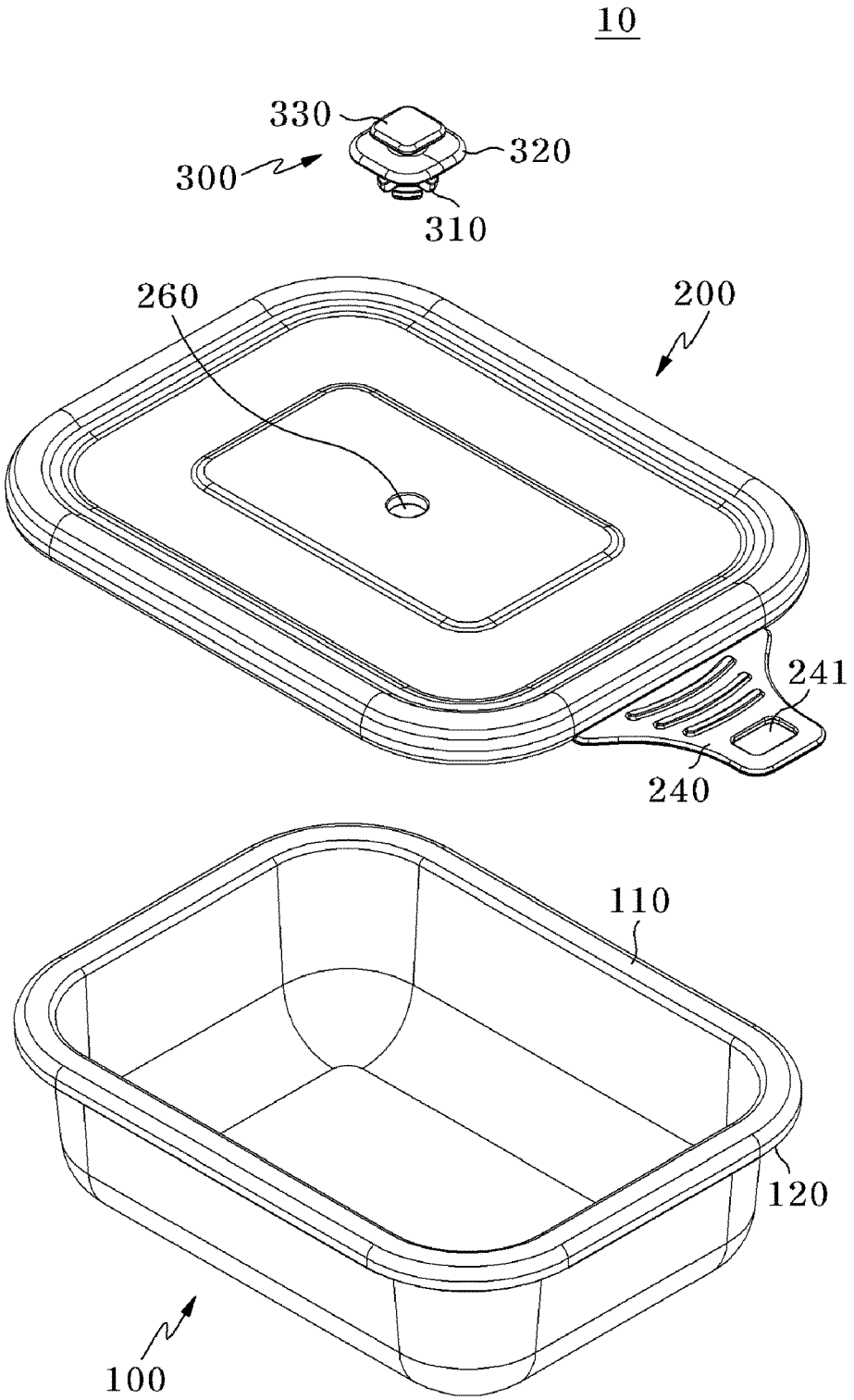
FIGS. 2 and 3 are exploded perspective views showing the vapor-tight container depicted in FIG. 1.
Figure 3:
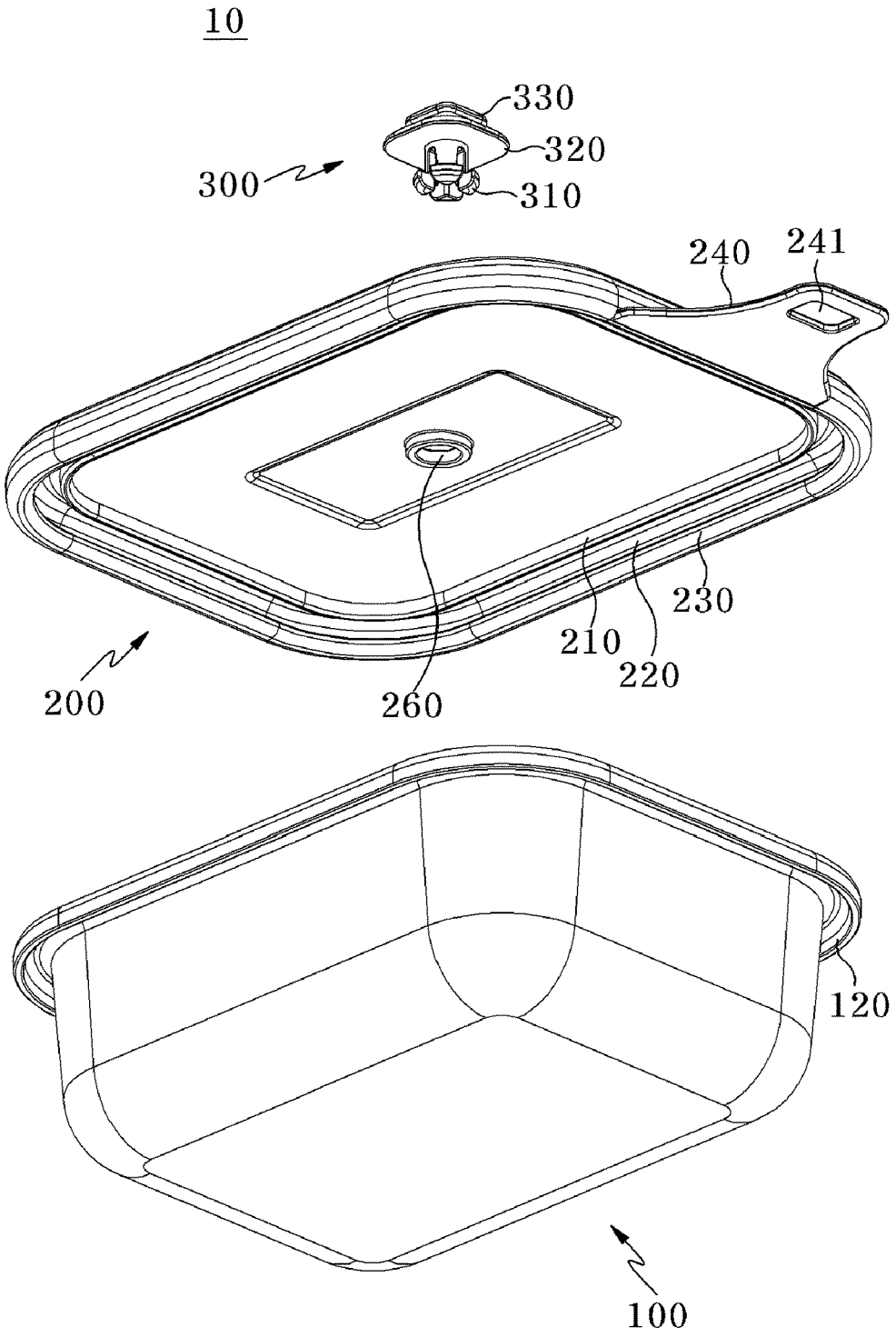
Figure 4:
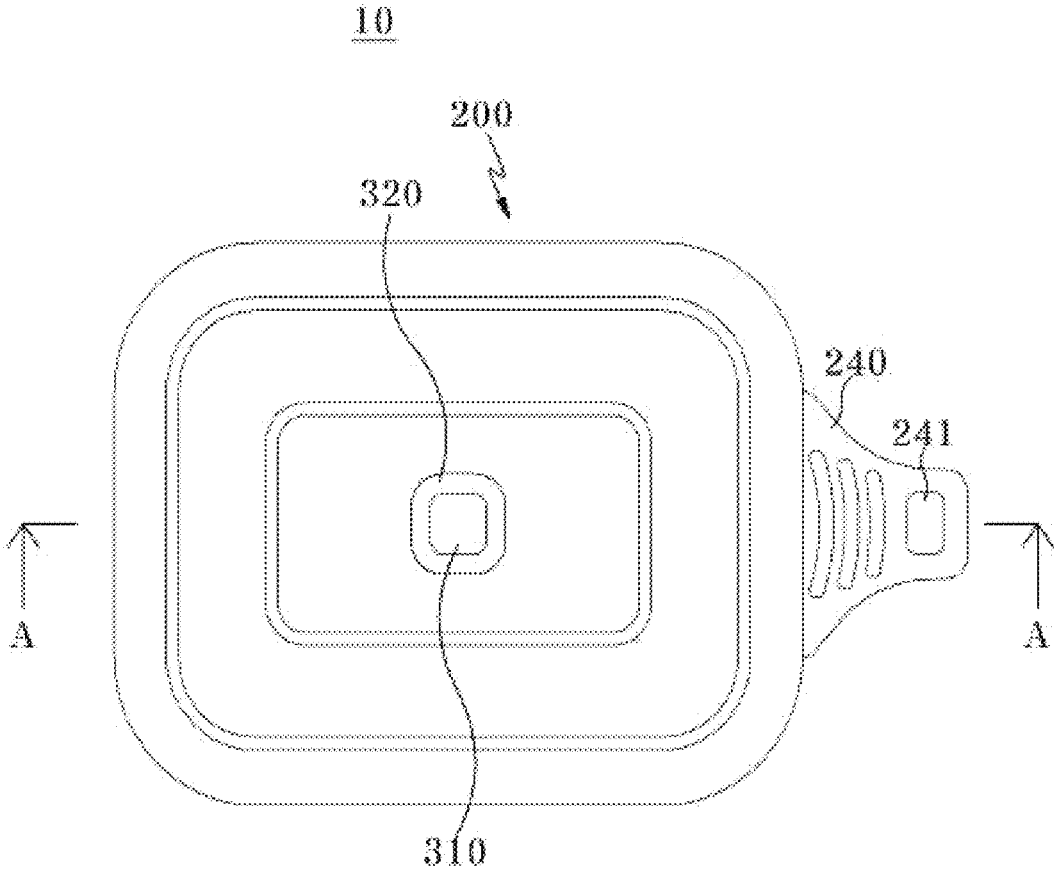
FIG. 4 is a plane view showing the vapor-tight container depicted in FIG. 1.

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", "comprises" and/or "comprising," when used in this specification, specify the presence of stated features, integers, steps, operations, elements, and/or components, but do not preclude the presence or addition of one or more other features, integers, steps, operations, elements, components, and/or groups thereof. In addition, a term such as a "unit", a "module", a "block" or like, when used in the specification, represents a unit that processes at least one function or operation, and the unit or the like may be implemented by hardware or software or a combination of hardware and software.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Preferred embodiments will now be described more fully hereinafter with reference to the accompanying drawings. However, they may be embodied in different forms and should not be construed as limited to the embodiments set forth herein. Rather, these embodiments are provided so that this disclosure will be thorough and complete, and will fully convey the scope of the disclosure to those skilled in the art.

Referring to FIGS. 1 to 8, a vapor-tight container 10 according to an embodiment of the present disclosure includes a container body 100, a container lid 200, and a check valve 300.

The container body 100 has a bottom surface and a sidewall protruding upward along a rim of the bottom surface and provides an inner space in which the cooked food or materials for cooking the food are accommodated. An upper portion of the container body 100 is opened to form an opening.

In addition, the container body 100 includes a first extension 110 formed in a flange shape primarily extending outward in a horizontal direction along the rim of the sidewall of the container body 100, and a locking protrusion 120 bent downward from an end of the first extension 110 and secondarily extending so that the container lid 200 is fixed thereto. In this embodiment, it is described that the primary extension is outward in a horizontal direction along the rim, but it may have a different shape (for example, an inclined shape), and a slightly recessed groove shape may also be used. Here, it is important that any shape capable of forming an accommodation space where vapor is collected falls within the scope of the present disclosure.

The container body 100 and/or the container lid 200 are preferably formed by injection molding with a flexibly and freely bendable, foldable or rolled material (for example, a silicone material), but the present disclosure is not limited thereto.

The container lid 200 covers the upper opening of the container body 100 and seals the inner space of the container body 100. The container lid 200 has a cover portion covering the opening of the container body 100, a sealing portion 210, a second extension 220, a coupling unit 230, a handle 240, a discharge hole 260, and a ring 250 having an elastic ring and the like.

The structure formed by extending from the rim of the container lid 200 may have various shapes such as a semicircular shape where a middle portion of the second extension 220 facing the horizontal portion 115 of the first extension 110 of the container body 100 is bent upwards, so as to form an accommodation portion 221 which is a space for accommodating a vapor generated at the inside of the container body 100.

The accommodation portion 221 is a space formed between the horizontal portion 115 which is the middle portion of the first extension 110 formed in the container body 100 and the second extension 220 of the container lid 200 facing the horizontal portion 115. The accommodation portion can be of various shapes, each of which is within the scope of the present disclosure.

The sealing portion 210 is used for primarily sealing the inner space of the container body 100, protrudes downward from an outer end of the cover portion and an inner end of the second extension 220, and is closely adhered to the inner surface of the upper end of the sidewall of the container body 100 in a flexible manner. In a state where the container lid 200 is coupled to the container body 100, the sealing portion 210 is closely adhered to the inner surface of the sidewall of the container body 100 to seal the inside of the container body 100. Accordingly, the vapor pressure formed at the inner space of the container body 100 is kept constant.

The second extension 220 extends outward from an outer end of the cover portion and is formed with a flange shape at the rim of the container lid 200. A coupling unit 230 formed to be hooked while surrounding the locking protrusion 120 of the container body 100 is provided at an outer end of the second extension 220. In addition, the middle portion of the second extension 220 has an upwardly curved shape to form the accommodation portion 221. In other words, the accommodation portion 221 is a space created when the first extension 110 and the second extension 220 bent in various shapes such as a semicircular shape are coupled together.

The accommodation portion 221 may have various shapes such as a square shape, a triangular shape, and a diamond shape. In particular, the accommodation portion 221 may be shaped so that a vapor is collected at the end point and causes the lid to be pulled up, namely with an angle of 45 degrees or above, rather than a gentle semicircular shape. This shape of the accommodation portion 221 is an example, and the accommodation portion 221 may have a large upper area or may be formed in various shapes. Importantly, the accommodation portion 221 may be shaped so that the force of the vapor collected at the accommodation portion 221 causes the lid to be pulled upward and thus the coupling unit 230 is more tightly coupled and tightly adhered to the locking protrusion 120, thereby sealing the vapor.

If the inside space of the container body 100 expands by the pressure of gas or vapor generated in the container body 100 due to the food, the accommodation portion 221 may extend to make a gap between the side of the container body 100 and the sealing portion 210 so that the vapor is discharged from the inside space of the container body 100 and collected into the accommodation portion 221. For example, if the vapor is collected to the maximum at a certain point (for example, at an upper vertex) of the accommodation portion 221, the coupling unit 230 of the container lid 200 is more closely adhered to and hooked by the locking protrusion 120 so that the container lid 200 is pulled upward. Due to the interaction between the coupling unit 230 and the locking protrusion 120, the container lid 200 is more firmly and tightly connected to the container body 100 to prevent the vapor of the container body 100 from escaping to the outside.

The coupling unit 230 is formed at a lower portion of the outer end of the second extension 220 and is fastened and fixed to surround the locking protrusion 120 formed at the container body 100, thereby secondarily sealing the inner space of the container body 100. If the container body 100 and the container lid 200 expand due to the pressure of the vapor generated in the container body 100, the container body 100 is pressurized in a downward direction, and the container lid 200 is pressurized in an upward direction. At this time, the locking protrusion 120 provided at the container body 100 is pressurized downward to press the coupling unit 230, and the coupling unit 230 provided at the container lid 200 is pressurized upward and is thus further tightly sealed with the locking protrusion 120.

Meanwhile, the leaked vapor collects in the accommodation portion 221, and as described above, the vapor collected in the accommodation portion 221 lifts the container lid 200 upward, and thus the coupling unit 230 and the locking protrusion 120 are further tightly coupled, thereby preventing leakage of the vapor.

In addition, the coupling unit 230 may be formed with a hook shape bent inward and may be used to open and close the container lid 200. For example, if a user pulls the handle 240 upward in a state where the container lid 200 is fastened to the container body 100, the coupling unit 230 is naturally released from the locking protrusion 120 to separate the container lid 200 from the container body 100.

Figure 8:
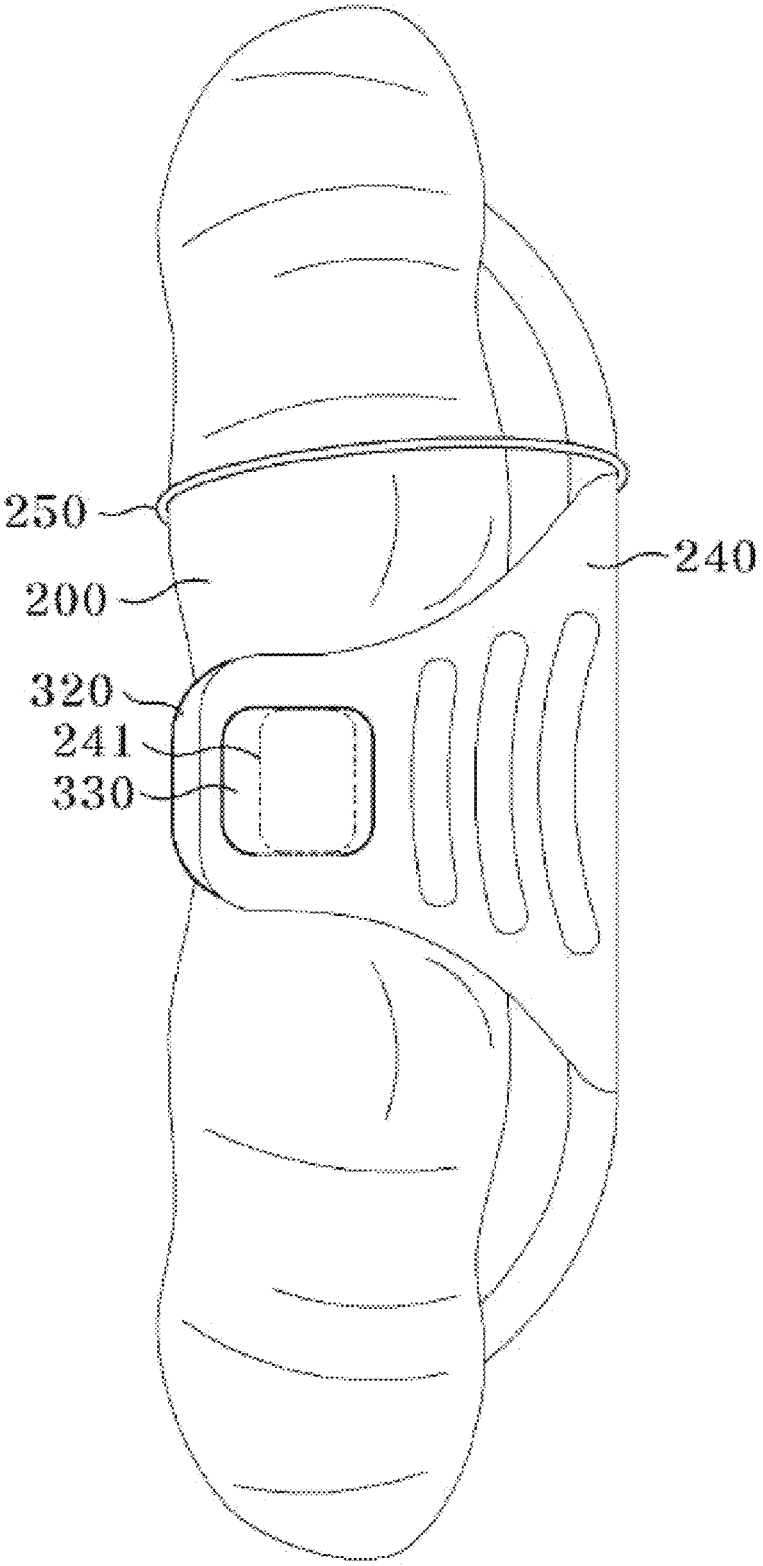
FIG. 8 is a diagram showing that the vapor-tight container depicted in FIG. 7 is rolled.

The handle 240 is formed by extending a predetermined length outwardly from one side of the container lid 200 and may be provided to allow the user to easily open the container lid 200. Also, a fitting groove 241 may be formed at an outer middle portion of the handle 240 in a longitudinal direction so that the container lid 200 may be fixed to the check valve 300 in a folded or rolled state. For example, as shown in FIG. 8, in a state where the container lid 200 is rolled from an opposite side where the handle 240 is formed, the fitting groove 241 is hooked and fixed to the fitting protrusion 330 formed at the check valve 300.

As described above, if the fitting groove 241 is formed at the handle 240 and is inserted into the check valve 300, the volume of the container 10 may be minimized when the container 10 made of a silicone material to be freely bent is stored. In particular, in a state where the container body 100 and the container lid 200 are coupled, they may be stored in a folded or rolled form, advantageously.

Figure 7:
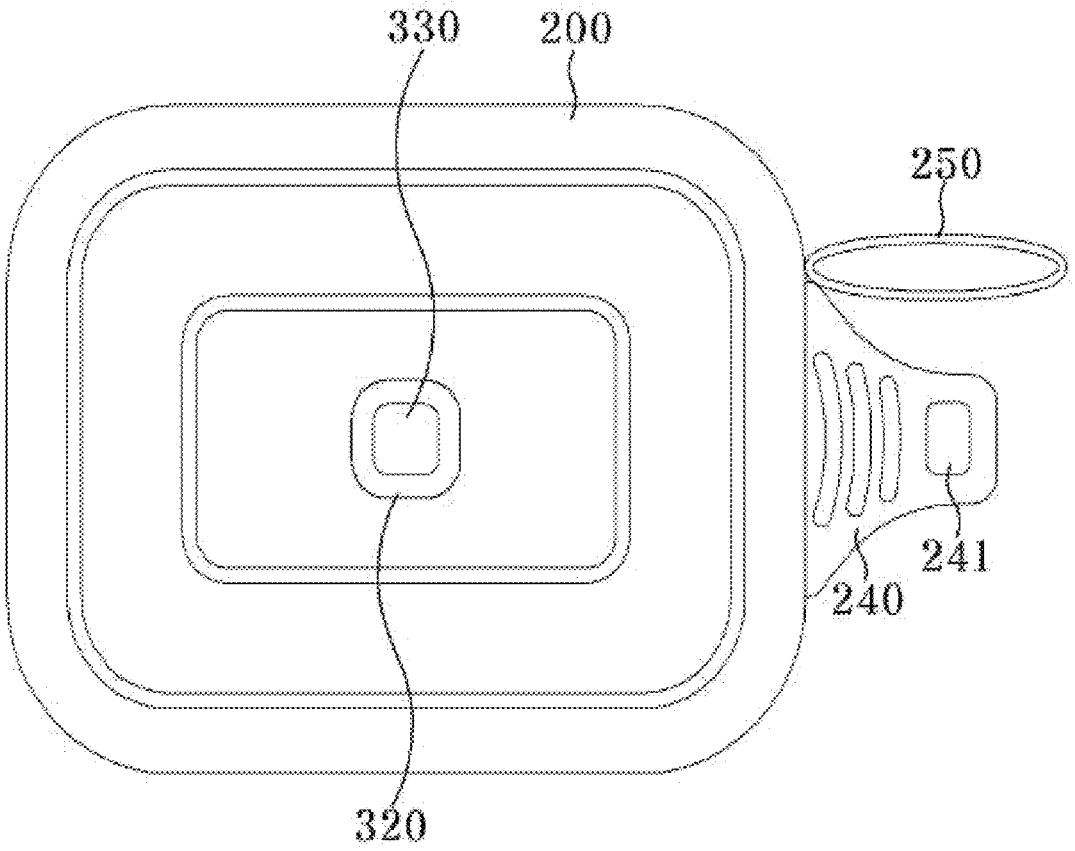
FIG. 7 is a plane view showing that a ring is added to the vapor-tight container of FIG. 1.

The ring 250 including the elastic ring is formed at one end of the container lid 200, preferably in the form of a band with elasticity, and may be provided to fix the container 10 in a folded or rolled state. For example, after use, the container 10 is folded or rolled from an opposite side where the ring 250 of FIG. 7 is provided, and in this state, the fitting groove 241 formed at the handle 240 is primarily fixed to the fitting protrusion 330 formed at the check valve 300 and then is secondarily fixed by inserting the ring 250 from the outside to the inside. In other words, the container 10 in a folded or rolled state is not unfolded or unrolled by an external impact due to the elastic force of the ring 250.

The discharge hole 260 is formed at a predetermined position (at a center in this embodiment) of the container lid 200 and is formed to discharge the vapor or gas generated inside the container lid 200 to the outside. The discharge hole may also be formed at another location instead of the center.

The check valve 300 is fitted to the discharge hole 260 and is provided to open or close the vapor or gas generated in the container 10 at a certain vapor pressure. The check valve 300 includes a coupling portion 310 fitted and fixed to the discharge hole 260, an opening plate 320 formed at an upper portion of the coupling portion 310 and closely adhered to an upper surface of the discharge hole 260 to seal the discharge hole 260, and a fitting protrusion 330 formed to be fitted to the fitting groove 241 formed at the handle 240.

The coupling portion 310 may be formed at a lower end of the opening plate 320, and a plurality of coupling portions may be formed at regular intervals in a circumferential direction. In addition, the coupling portion 310 includes a support 311 inserted into the discharge hole 260 to move upward or downward, and a tight fitting portion 312 closely adhered to the bottom surface of the discharge hole 260 to restrain the movement of the support 311 when the support 311 is moved upward.

Meanwhile, a space 313 is formed between the coupling portion 310 and another coupling portion 310 adjacent thereto so that elasticity is generated at the plurality of coupling portions 310. Also, when the check valve 300 moves upward, a certain amount of the vapor or gas generated in the container 10 is discharged to the outside through space 313.

The opening plate 320 is located on the discharge hole 260 formed at the container lid 200 and is configured to seal or open the discharge hole 260 by the movement of the check valve 300. For example, if the check valve 300 is moved upward, the opening plate 320 is spaced apart from the discharge hole 260, so that the space 313 formed in the coupling portion 310 is exposed to the outside. At this time, the vapor or gas generated inside the container 10 is discharged to the outside through the space 313 exposed outward.

The fitting protrusion 330 is formed to be spaced apart from the upper surface of the opening plate 320, and a groove is formed between the opening plate 320 and the fitting protrusion 330 so that the inner surface of the fitting groove 241 formed at the handle 240 is inserted and fixed therein.

The check valve 300 is installed at the center of the container lid 200. When a pressure over a certain level is generated due to the vapor generated in the container 10, the container 10 may explode. In order to prevent such an explosion, the check valve 300 is installed and used in the present disclosure.

In other words, if a certain pressure is generated inside the container 10, the inside of the container 10 expands and the check valve 300 moves upward. At this time, the vapor inside the container 10 is discharged to the outside by means of the check valve 300 moved upward.

Figure 9:
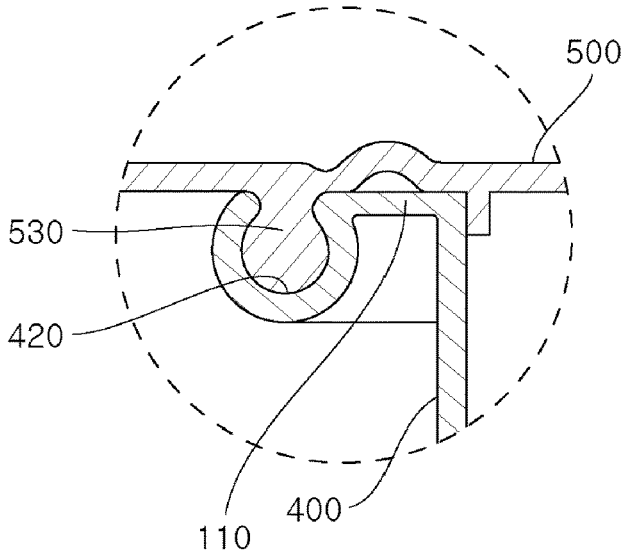
FIG. 9 is a diagram for illustrating a coupling method of a container body and a container lid of the vapor-tight container according to another embodiment of the present disclosure.

FIG. 9 is a diagram for illustrating a coupling method of a container body and a container lid of the vapor-tight container according to another embodiment of the present disclosure. Referring to FIG. 9, the container body 400 has a coupling groove 420 formed at an end of the first extension 110. The coupling groove 420 is a groove with an open top, and the top opening is formed narrower than the inside. The container lid 500 has a coupling protrusion 530 protruding downward from the outer end of the second extension 220. The coupling protrusion 530 is shaped to be accommodated in and coupled to the coupling groove 420, and the coupling groove 420 and the coupling protrusion 530 may be coupled and separated by means of elastic deformation. The remaining configuration except for the coupling groove 420 and the coupling protrusion 530 is identical to those of the vapor-tight container according to the embodiment depicted in FIGS. 1 to 8, and thus it is not described in detail here.

Figure 5:
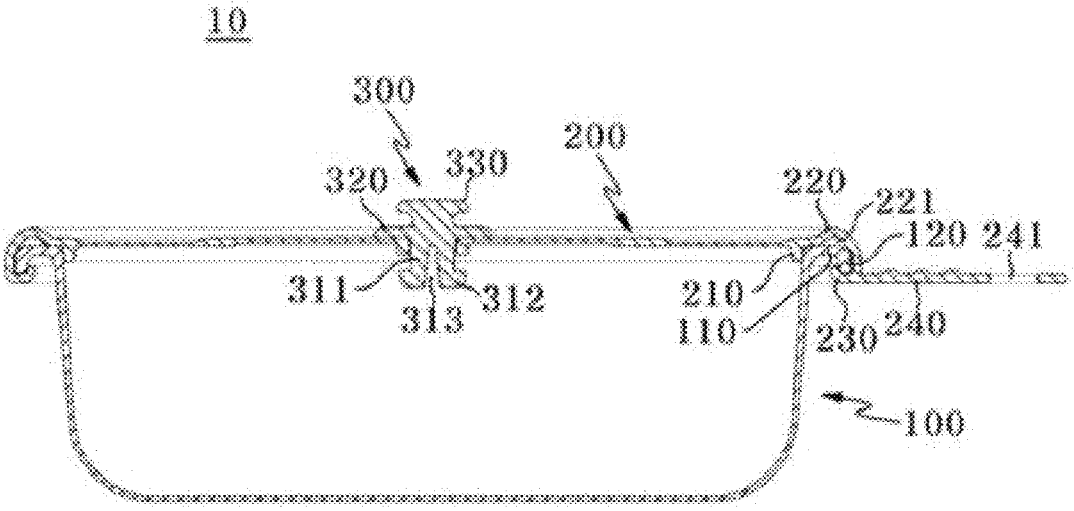
FIGS. 5 and 6 are cross-sectional views showing the vapor-tight container, taken along the line A-A of FIG. 3.
Figure 6:
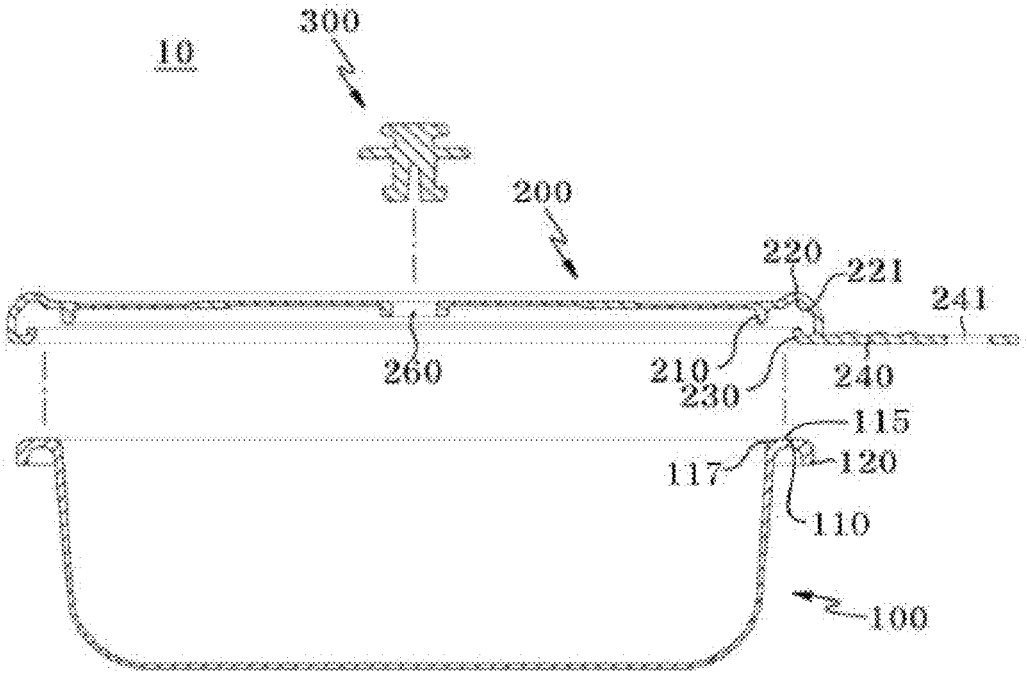

Also, though not shown in FIG. 9, the coupling unit 230 depicted in FIG. 5 may be additionally provided in the embodiment of FIG. 9. In other words, the coupling unit 230 depicted in FIG. 5 may be formed at an end of the container lid 500 of FIG. 9 to secure and fix a downwardly protruding portion while surrounding the downwardly protruding portion from the below.

Figure 10:
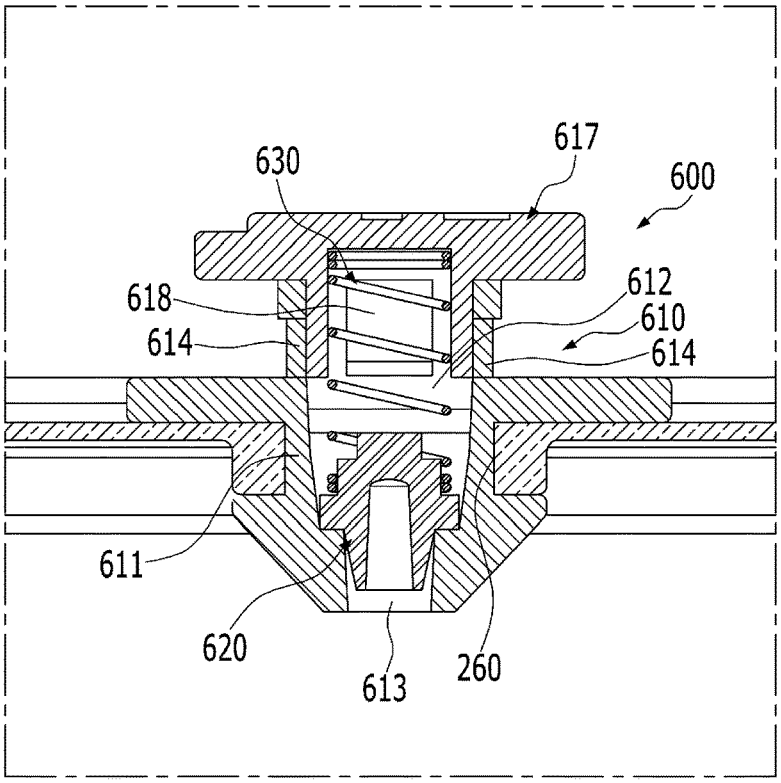
FIGS. 10 and 11 are diagrams showing a check valve of the vapor-tight container according to another embodiment of the present disclosure.
Figure 11:
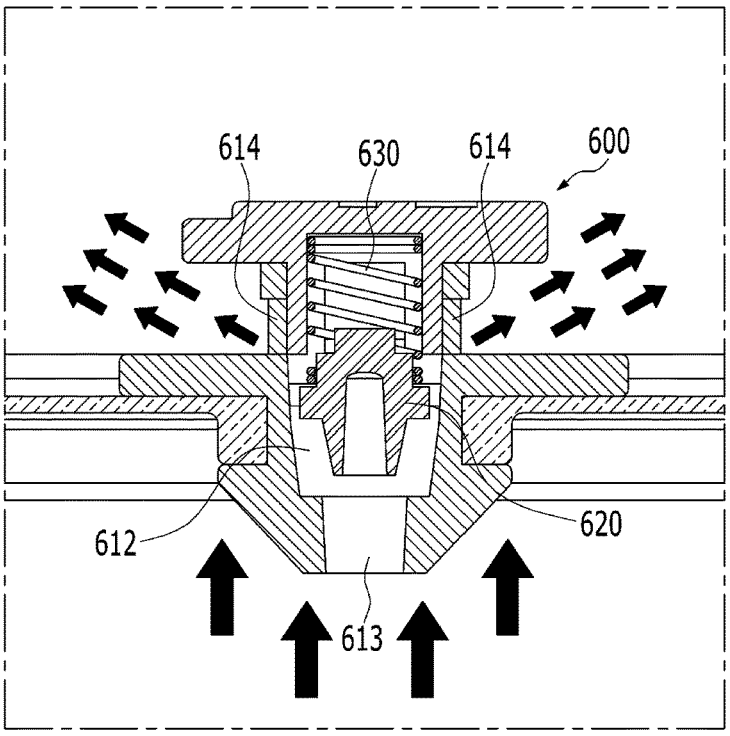

FIGS. 10 and 11 are diagrams showing a check valve of the vapor-tight container according to another embodiment of the present disclosure. Referring to FIGS. 10 and 11, the check valve 600 includes a valve body 610, a valve component 620 accommodated in the valve body 610, and an elastic member 630 accommodated in the valve body 610 to push the valve component 620.

The valve body 610 includes a coupling member 611 fitted to the discharge hole 260 formed at the container lid 200 and a stopper member 617 coupled to an upper end of the coupling member 611.

The coupling member 611 is inserted into the discharge hole 260 of the container lid 200 to close the discharge hole 260. A valve space 612 is formed inside the coupling member 611. The coupling member 611 has an inside path 613 for connecting the valve space 612 and the inner space of the container body 100, and an outside path 614 for connecting the valve space 612 and the outside of the container lid 200. The valve space 612 accommodates the valve component 620 and the elastic member 630. The upper end of the coupling member 611 is opened, and the opened upper end is closed by the stopper member 617.

The stopper member 617 is coupled to the coupling member 611 to close the open top of the coupling member 611. A protrusion 618 is formed at the stopper member 617 to be fitted to the elastic member 630.

The valve component 620 is accommodated in the valve space 612 of the valve body 610 to block the inside path 613 in a form as shown in FIG. 10. If the valve component 620 moves and is located to be spaced apart from the inside path 613 as shown in FIG. 11, the inside path 613 and the valve space 612 are connected to each other, and the vapor of the inner space of the container body 110 is discharged to the outside through the inside path 613, the valve space 612 and the outside path 614.

The elastic member 630 is accommodated in the valve space 612 of the valve body 610 and gives an elastic force to the valve component 620 so that the valve component 620 keeps blocking the inside path 613. In this embodiment, the elastic member 630 is a compression coil spring, which has one end inserted into the valve component 620 and the other end fitted to the protrusion 618 of the stopper member 617. The discharge pressure may be adjusted according to the elastic modulus of the elastic member 630.

Figure 12:
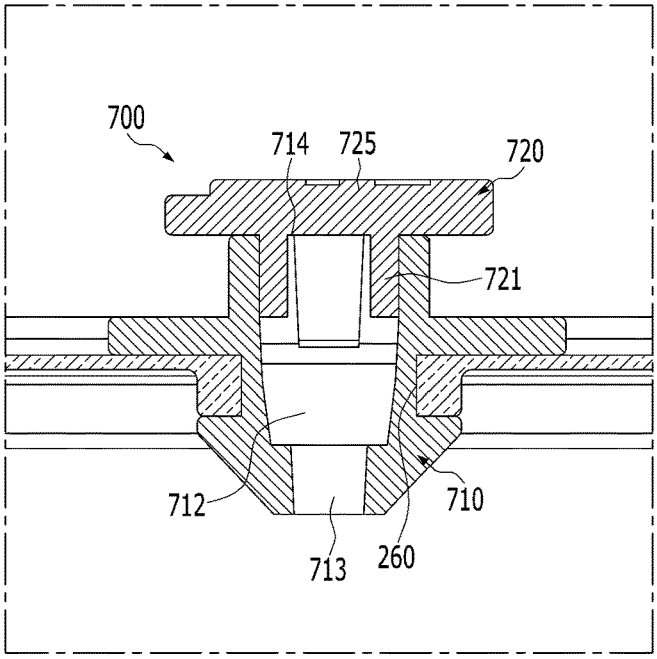
FIGS. 12 and 13 are diagrams showing a check valve of the vapor-tight container according to another embodiment of the present disclosure.
Figure 13:
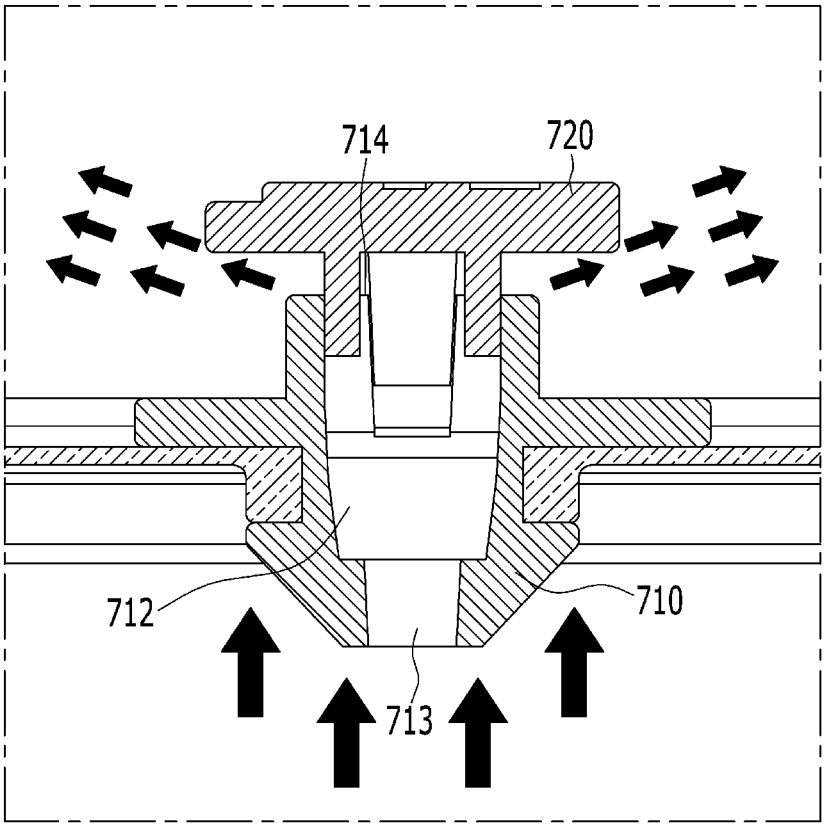

FIGS. 12 and 13 are diagrams showing a check valve of the vapor-tight container according to another embodiment of the present disclosure. Referring to FIGS. 12 and 13, the check valve 700 includes a valve body 710 and a valve cover 720 coupled to the valve body 710.

The valve body 710 is fitted into the discharge hole 260 of the container lid 200 to close the discharge hole 260. A valve space 712 is formed inside the valve body 710. The valve body 710 has an inside path 713 for connecting the valve space 712 and the inner space of the container body 100 and an outside path 714 for connecting the valve space 712 and the outside of the container lid 200. The outside path 714 is a passage formed by opening the upper end of the valve space 712. The outside path 714 is opened or closed by the valve cover 720.

The valve cover 720 is inserted into and coupled to the open top of the valve body 710 to be movable with respect to the valve body 710 to open or close the outside path 714 of the valve body 710. The valve cover 720 has an insert portion 721 inserted into the valve space 712 through the open path 714 which is an open top of the valve body 710, and a cover plate 725 located at the top of the insert portion 721 to cover the outside path 714. As shown in FIG. 12, when the cover plate 725 is in contact with the outside path 714, vapor discharge through the outside path 714 is prevented, and if the pressure of the inner space of the container body 100 rises so that the valve cover 720 is pushed upward as shown in FIG. 13, the cover plate 725 is separated from the outside path 714 so that the vapor inside the container body 100 is discharged to the outside through the outside path 714. Depending on the weight of the valve cover 720, the discharge pressure may be adjusted.

While the present disclosure has been described with reference to the embodiments illustrated in the figures, the embodiments are merely examples, and it will be understood by those skilled in the art that various changes in form and other embodiments equivalent thereto can be performed. Therefore, the technical scope of the disclosure is defined by the technical idea of the appended claims.

The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. A vapor tight container comprising: a container body having a first extension formed to extend outwards along a rim of a sidewall thereof and a locking protrusion bent downwards from an end of the first extension; and a container lid configured to cover an upper portion of the container body so that the inside of the container body is sealed, wherein the container lid comprises:

a second extension formed to extend from a rim of the container lid forming an accommodation portion above a horizontal portion of the first extension so that a vapor generated in the container body is accommodated therein, the second extension being in contact with an upper end surface of the first extension when said container lid seals said container body; and a coupling unit formed at a lower portion of the second extension, said coupling unit surrounding the locking protrusion formed at the container body to secure the lid to the container body;

wherein a discharge hole is formed in the container lid, wherein a check valve is further provided to open or close the discharge hole, wherein the container lid is made of a flexible material and further includes a handle formed to extend outwards at one side of the container lid, wherein a fitting groove is formed in the handle so that the check valve may be inserted therein, wherein the check valve includes a coupling portion configured to fit into the discharge hole, an opening plate formed at an upper portion of the coupling portion configured to contact an upper surface of the discharge hole to seal the discharge hole, and a fitting protrusion formed at an upper portion of the opening plate, said fitting protrusion dimensioned to fit within the fitting groove formed at the handle.

2. The vapor-tight container of claim 1, wherein the check valve includes a valve body inserted into the discharge hole to close the discharge hole and having a valve space formed therein, a valve component movably accommodated in the valve space, and an elastic member accommodated in the valve space to apply an elastic force to the valve component, wherein the valve body has an inside path for connecting the valve space and an inner space of the container body, and an outside path for connecting the valve space and the outside of the container lid, and wherein the elastic member provides the elastic force against the valve component to close the inside path.

3. The vapor-tight container of claim 1, wherein the check valve includes a valve body inserted into the discharge hole to close the discharge hole and having a valve space formed therein with open upper and lower ends, and a valve cover movably inserted into the open upper end of the valve body.

4. A vapor-tight container comprising:

a container body having a first extension formed to extend outwards along a rim of a sidewall thereof and a coupling groove formed at an end of the first extension and having an open upper portion; and a container lid configured to cover an upper portion of the container body so that the inside of the container body is sealed, wherein the container lid comprises:

a second extension formed to extend from a rim of the container lid forming an accommodation portion above a horizontal portion of the first extension so that a vapor generated in the container body is accommodated therein, the second extension being in contact with an upper end surface of the first extension when the container lid seals the container body; and a coupling protrusion located at an end of the second extension and detachably inserted into the coupling groove, wherein a discharge hole is formed in the container lid, wherein a check valve is further provided to open or close the discharge hole, wherein the container lid is made of a flexible material and further includes a handle formed to extend outwards at one side of the container lid, wherein a fitting groove is formed in the handle so that the check valve may be inserted therein, wherein the check valve includes a coupling portion configured to fit into the discharge hole, an opening plate formed at an upper portion of the coupling portion configured to contact an upper surface of the discharge hole to seal the discharge hole, and a fitting protrusion formed at an upper portion of the opening plate, the fitting protrusion dimensioned to fit within the fitting groove formed at the handle.

5. The vapor-tight container of claim 4, wherein the check valve includes a valve body inserted into the discharge hole to close the discharge hole and having a valve space formed therein, a valve component movably accommodated in the valve space, and an elastic member accommodated in the valve space to apply an elastic force to the valve component, wherein the valve body has an inside path for connecting the valve space and an inner space of the container body, and an outside path for connecting the valve space and the outside of the container lid, and wherein the elastic member provides the elastic force against the valve component to close the inside path.

6. The vapor-tight container of claim 4, wherein the check valve includes a valve body inserted into the discharge hole to close the discharge hole and having a valve space formed therein with open upper and lower ends, and a valve cover movably inserted into the open upper end of the valve body.

* * * * *